US011598502B1

(12) United States Patent
Hale

(10) Patent No.: US 11,598,502 B1
(45) Date of Patent: Mar. 7, 2023

(54) LAMP PLATFORM ASSEMBLY

(71) Applicant: Michael Hale, Port St. Lucie, FL (US)

(72) Inventor: Michael Hale, Port St. Lucie, FL (US)

( * ) Notice: Subject to any disclaimer, the term of this patent is extended or adjusted under 35 U.S.C. 154(b) by 0 days.

(21) Appl. No.: 17/385,423

(22) Filed: Jul. 26, 2021

Related U.S. Application Data

(60) Provisional application No. 63/056,373, filed on Jul. 24, 2020.

(51) Int. Cl.

| | |
|---|---|
| ***F21S 8/08*** | (2006.01) |
| ***F21V 21/22*** | (2006.01) |
| ***F21S 9/03*** | (2006.01) |
| ***F21V 21/26*** | (2006.01) |
| ***F21V 21/08*** | (2006.01) |
| *F21Y 115/10* | (2016.01) |

(52) U.S. Cl.
CPC ..... *F21S 8/08* (2013.01); *F21S 9/032* (2013.01); *F21V 21/08* (2013.01); *F21V 21/22* (2013.01); *F21V 21/26* (2013.01); *F21Y 2115/10* (2016.08)

(58) Field of Classification Search
CPC .. F21S 8/08; F21S 9/032; F21V 21/08; F21V 21/22; F21V 21/26
See application file for complete search history.

(56) References Cited

U.S. PATENT DOCUMENTS

| | | | | |
|---|---|---|---|---|
| 2,579,348 | A | 12/1951 | Taylor | |
| 3,113,531 | A | 12/1963 | Barnard | |
| 6,748,873 | B2 | 6/2004 | Brown, Sr. | |
| 7,744,048 | B1 * | 6/2010 | McKellery | F16M 11/046 248/176.1 |
| 2003/0076441 | A1 * | 4/2003 | Maeda | H04N 1/19594 348/375 |
| 2004/0144289 | A1 | 7/2004 | Lu | |
| 2005/0135865 | A1 * | 6/2005 | Cui | B43K 29/10 362/118 |
| 2006/0038093 | A1 | 2/2006 | Putre et al. | |
| 2006/0077286 | A1 * | 4/2006 | Wenderski | G03B 17/561 348/E5.025 |
| 2007/0131825 | A1 * | 6/2007 | Skrodzki | F16M 11/16 248/177.1 |

(Continued)

FOREIGN PATENT DOCUMENTS

| | | |
|---|---|---|
| CN | 207778118 U | 8/2018 |

OTHER PUBLICATIONS

YouTube video, LightAccents Medusa Floor Lamp 16196 Assembly Video. Published Mar. 11, 2019. https://www.youtube.com/watch?v=0ao6SpQ4SAM&t=5s (Year: 2019).*

(Continued)

*Primary Examiner* — Evan P Dzierzynski
(74) *Attorney, Agent, or Firm* — John Rizvi; John Rizvi, P.A.—The Patent Professor®

(57) ABSTRACT

A lamp platform assembly for emitting at least one light beam in various patterns, directions or orientations may include multi-positional support platform. At least one lamp unit may be carried by the support platform. Each lamp unit may be selectively positional to direct an emitted light beam in a selected direction or orientation. At least one electrical system may electrically interface with the at least one lamp unit. The at least one electrical system may be configured to provide electrical power to the at least one lamp unit.

14 Claims, 7 Drawing Sheets

(56) References Cited

U.S. PATENT DOCUMENTS

| | | | | |
|---|---|---|---|---|
| 2012/0227635 | A1* | 9/2012 | Stobart | G02B 6/006 108/23 |
| 2013/0003394 | A1* | 1/2013 | Foltz | F21V 17/007 362/382 |
| 2019/0307244 | A1 | 10/2019 | Wilson | |

OTHER PUBLICATIONS

PDF with screen captures from LightAccents Medusa Floor Lamp 16196 Assembly Video. Published Mar. 11, 2019. https://www.youtube.com/watch?v=0ao6SpQ4SAM&t=5s (Year: 2019).*

* cited by examiner

LAMP PLATFORM ASSEMBLY

CROSS-REFERENCE TO RELATED APPLICATIONS

This application claims the benefit of U.S. Provisional Patent Application No. 63/056,373, filed on Jul. 24, 2020, which is incorporated by reference herein in its entirety.

FIELD OF THE INVENTION

The present invention relates generally to lamps, and more particularly, to a lamp platform assembly having a multi-positional support platform with at least one lamp unit on the support platform to emit at least one light beam in various patterns, directions or orientations.

BACKGROUND OF THE INVENTION

A light fixture an electrical device that includes a source of illumination. Light fixtures are commonly used to provide various types of light in indoor and outdoor settings. A typical light fixture may include a mounting bracket and one or more lamps supported by the mounting bracket. Each lamp may include a light bulb which is mounted into an electrical socket connected to a source of electricity. In some types of light fixtures, the light bulb may be threaded into the electrical socket to facilitate ease in replacement of the light bulb. In other types of light fixtures, the light bulb may be hard-wired in place.

Some types of light fixtures may include a switch which enables a user to selectively energize the electrical socket and light bulb. The switch may include a dimmer control which enables a user to control the illumination brightness of the light bulb. Permanent light fixtures, such as overhead light fixtures in the rooms of a home or office building, are typically connected to a wall switch for manual illumination. Other types of light fixture arrangements may include motion sensors which activate the light fixture upon sensing motion in the room which the light fixtures illuminate.

Table lamps are popular items used in homes and offices. A typical table lamp includes an upward-standing base or pedestal which typically rests on a table or other support. An electrical socket extends from the top of the pedestal. A light bulb is threaded in the electrical socket. A lamp shade is typically mounted on the electrical socket and covers the light bulb to diffuse the light emitted by the light bulb. An electrical cord which is connected to the electrical socket extends from the pedestal and terminates in a plug for insertion into a wall or floor outlet. Floor lamps are similar to table lamps except the base or pedestal typically rests on the floor. The pedestal and lamp shade of table and floor lamps are highly variable and customizable to accord with the aesthetic tastes of the user.

Some light fixtures may include features such as reflectors which reflect or direct light emitted by the light bulb. Other light fixtures may include apertures, lenses or the like which modify the light beam as it exits the electrical socket. These features may create lighting effects which are highly variable.

In recent years, light-emitting diodes (LEDs) have exploded in popularity. An LED is a semiconductor light source which emits light when electrical current flows through the light source. As the current flows, electrons in the light source recombine with electron holes and release photons. The color of the emitted light corresponds to the energy of the released photons and is determined by the energy required for electrons to cross the band gap of the semiconductor.

Some of the advantages of LEDs over conventional lighting include lower energy consumption, longer lifetime, improved physical robustness, smaller size, and faster switching. LEDs are used in a wide variety of different applications including aviation, automotive, advertising, traffic signals, and medical devices.

In some applications, it may be desirable to mount multiple lamps on a platform which is positionally adjustable to illuminate objects or create various lighting effects.

Accordingly, there is need for a lamp platform assembly having a multi-positional support platform with at least one lamp unit on the support platform to emit at least one light beam in various patterns, directions or orientations.

SUMMARY OF THE INVENTION

The present invention is directed to a lamp platform assembly having a multi-positional support platform with at least one lamp unit on the support platform to emit at least one light beam in various patterns, directions or orientations. The lamp platform may include a support platform. At least one lamp unit may be provided on the support platform. Each lamp unit may be selectively positional to direct an emitted light beam in a selected direction or orientation. In some embodiments, the lamp platform may be mounted on a platform stand. The lamp platform may be selectively positionally adjustable to vary the positions of the lamp units. At least one electrical system may provide electrical power to the lamp units.

In an illustrative implementation of the invention, a lamp platform assembly may include a support platform. A plurality of lamp units may be provided on the lamp platform. Each lamp unit may be selectively and individually adjustable in orientation to control the direction of illumination of each lamp unit. The lamp platform may be mounted on a platform stand. At least one electrical system may electrically interface with each lamp unit to provide electrical current to the lamp unit.

In a second aspect, the plurality of lamp units may be arranged in a circular pattern on the support platform.

In another aspect, the support platform may be selectively adjustable in height.

In another aspect, the support platform may be selectively rotationally adjustable.

In another aspect, the platform stand may include a plurality of stand legs.

In another aspect, the plurality of stand legs of the platform stand may be adjustable.

In another aspect, the platform stand may include a tripod stand.

In another aspect, an arm receptacle may be supported by the plurality of stand legs and a platform support arm may be telescopically extendable from the arm receptacle, and the support platform may be supported by the platform support arm.

In another aspect, the support platform may be circular with a lower platform surface, an upper platform surface and a circular outer platform edge extending between the lower platform surface and the upper platform surface, and the plurality of lamp units may be provided on the upper platform surface.

In another aspect, the electrical system which provides electrical current to the lamp units may capture and utilize solar energy.

In another aspect, the electrical system may include at least one solar panel recess provided in the upper platform surface of the support platform and at least one solar panel seated in the solar panel recess in electrically interfacing relationship to each lamp unit.

In another aspect, at least one rechargeable battery may be provided in the solar panel recess in electrically interfacing relationship to each lamp unit, and the at least one solar panel may electrically interface with the at least one battery.

In another aspect, each lamp unit may include a lamp housing on the upper platform surface of the support platform and at least one light emitting device in the lamp housing.

In another aspect, the at least one light emitting device of each lamp unit may include at least one LED (light emitting diode).

In another aspect, the lamp housing of each lamp unit may be generally elongated.

In another aspect, at least one lens may be disposed in the lamp housing and a light tube may connect the LED to the at least one lens.

In another aspect, at least one lamp arm may connect the lamp housing of each lamp unit to the support platform.

In another aspect, the at least one lamp arm may be adjustable in position.

In another aspect, a lamp arm opening may extend through the support platform, and each lamp arm may extend through the lamp arm opening.

In another aspect, a lamp arm support plate may support or retain the lamp arm in the lamp arm opening.

In another aspect, each lamp arm support plate may include a plate disk and an arm cavity in the plate disk and registering with the lamp arm opening, and the lamp arm may terminate inside the arm cavity.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
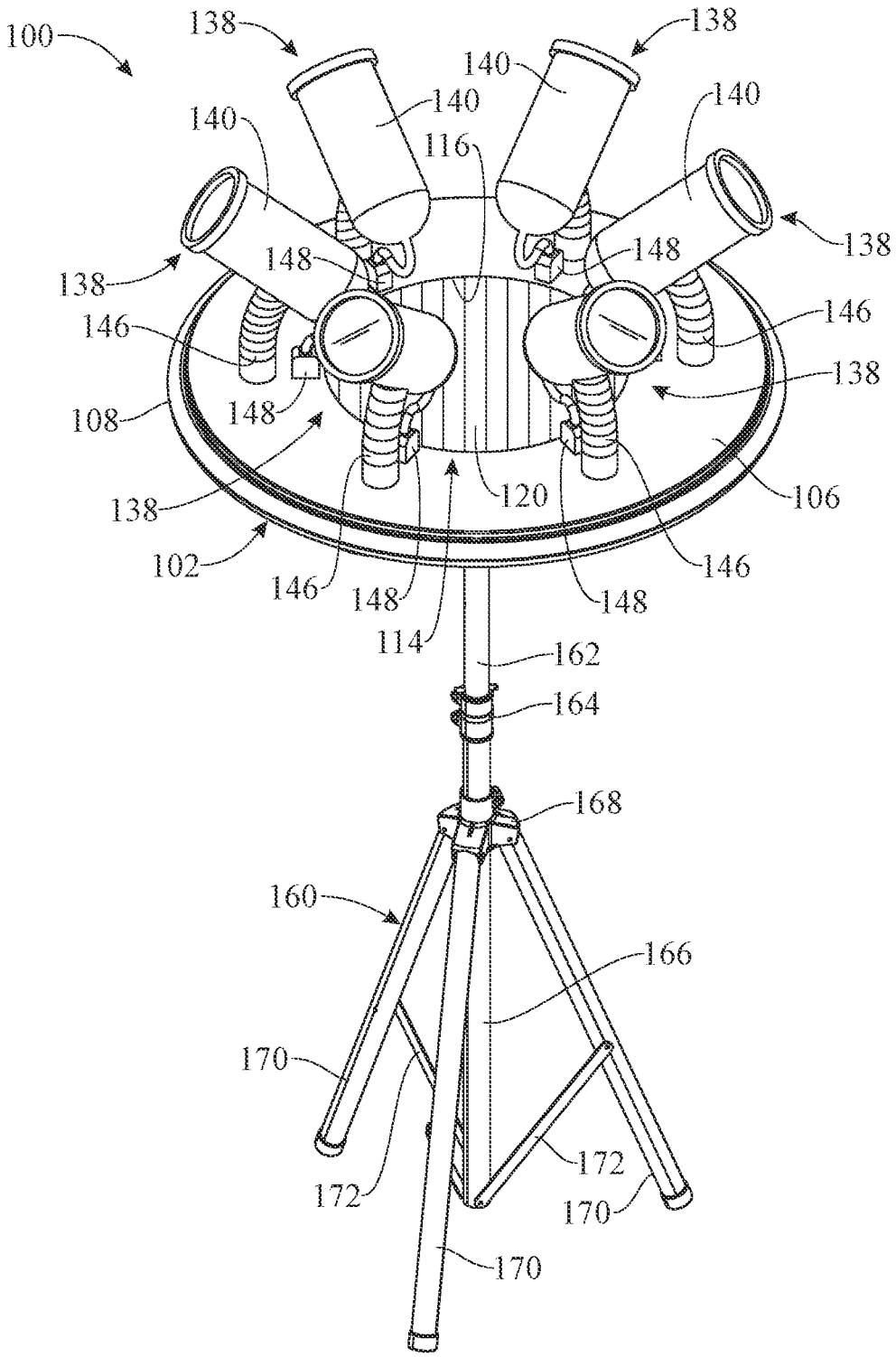
FIG. 1 presents a top perspective view of a lamp platform assembly in accordance with an illustrative embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a lamp platform assembly having a multi-positional support platform with lamp units on the support platform to emit light beams in various patterns or directions.

Referring initially to FIGS. 1-7, a lamp platform assembly, assembly 100, is illustrated in accordance with an exemplary embodiment of the present invention. As shown for instance in FIG. 1, the assembly 100 may include a support platform 102. In some embodiments, the support platform 102 may be circular with a lower platform surface 104, an upper platform surface 106 and a circular outer platform edge 108. In other embodiments, the support platform 102 may be polygonal or may have other alternative shapes.

Figure 2:
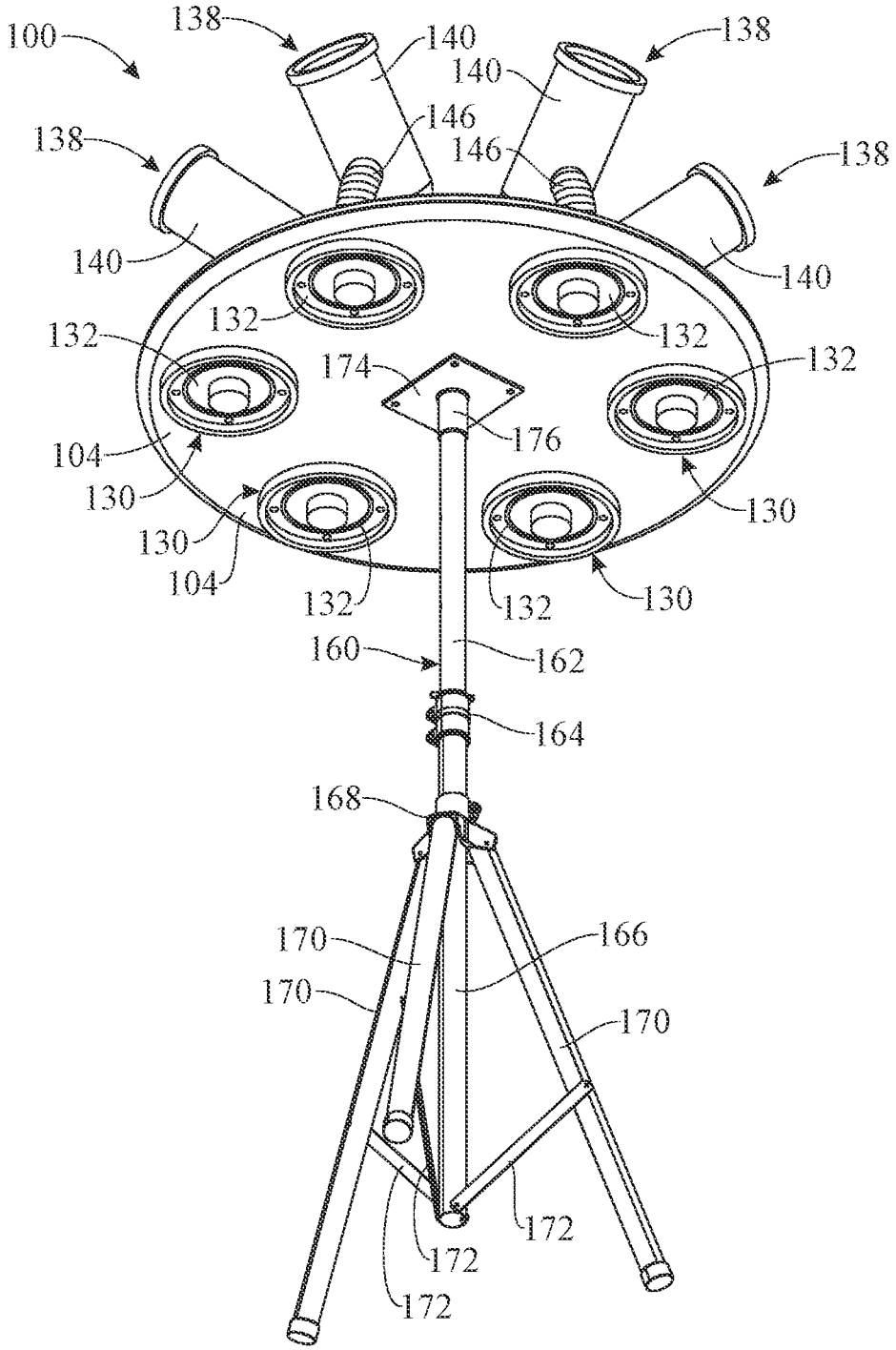
FIG. 2 presents a bottom perspective view of the illustrative lamp platform assembly illustrated in FIG. 1.
Figure 3:
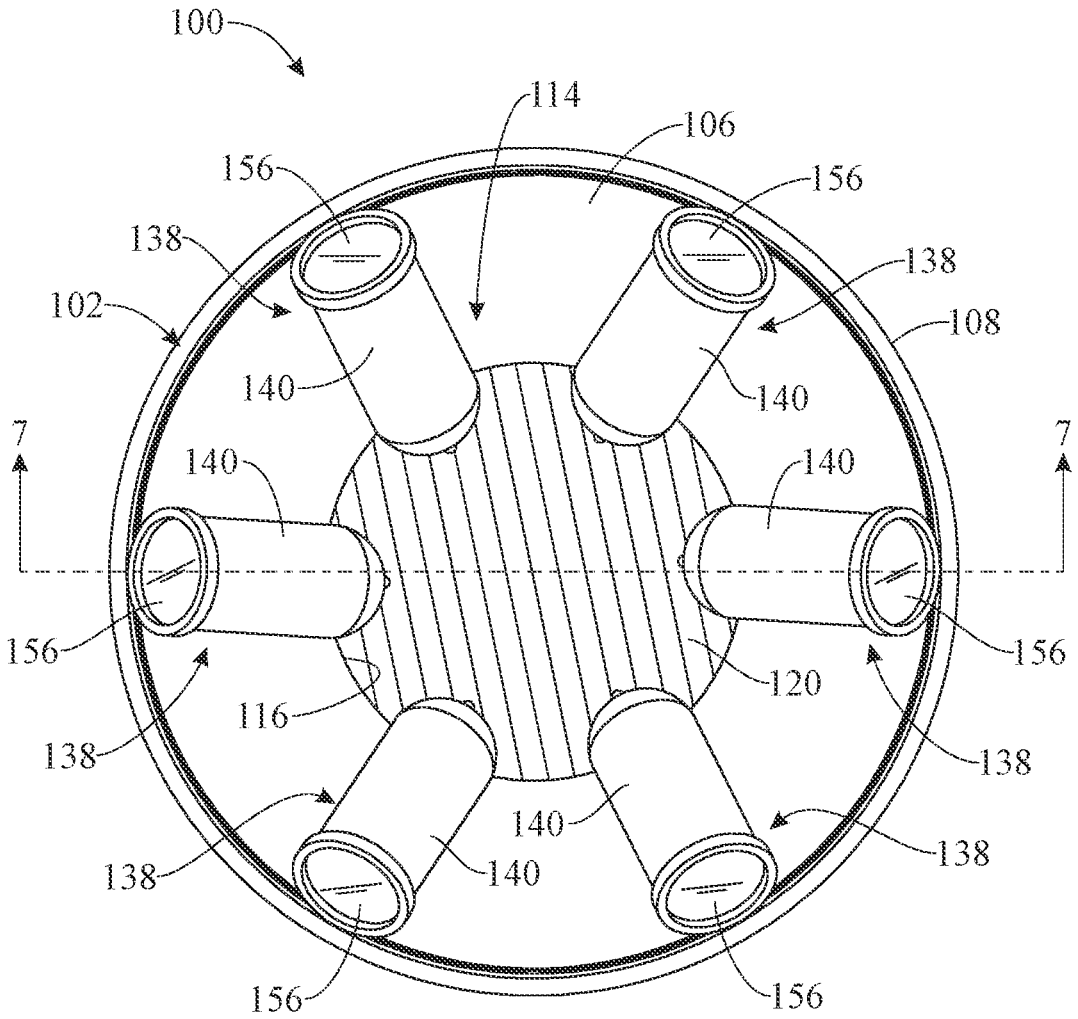
FIG. 3 presents a top view of the illustrative lamp platform assembly illustrated in FIG. 1.

In some embodiments, the assembly 100 may include a platform stand 160. The platform stand 160 may include a receptacle arm 162 which may extend downwardly from the lower platform surface 104 of the support platform 102, as illustrated in FIG. 2. A leg support member 166 may be selectively extendable and retractable with respect to the receptacle arm 162 according to the knowledge of those skilled in the art. Accordingly, in some embodiments, receptacle arm collar 164 may be provided on the receptacle arm 162. The leg support member 166 may be telescopically extendable from the receptacle arm 162 and the receptacle arm collar 164. The receptacle arm collar 164 may releasably engage the leg support member 166 according to the knowledge of those skilled in the art, such as through a threaded bolt or spring-loaded pin, for example and without limitation, to secure a selected length of the leg support member 166 with respect to the receptacle arm 162.

A plurality of stand legs 170 may extend from the leg support member 166. In some embodiments, the platform stand 160 may be a tripod stand, as illustrated, in which case three stand legs 170 may extend from the leg support member 166. The stand legs 170 may be mounted to the leg support member 166 according to the knowledge of those skilled in the art. In some embodiments, a leg mount collar 168 may be provided on the leg support member 166. The stand legs 170 may be pivotally attached to the leg mount collar 168. Accordingly, the stand legs 170 may be selectively deployable between a retracted, storage configuration (not illustrated) and an extended, functional configuration, as illustrated in FIGS. 1 and 2. Leg stabilizers 172 may extend between each stand leg 170 and the leg support member 166 to stabilize the stand legs 170 in the extended configuration.

Figure 7:
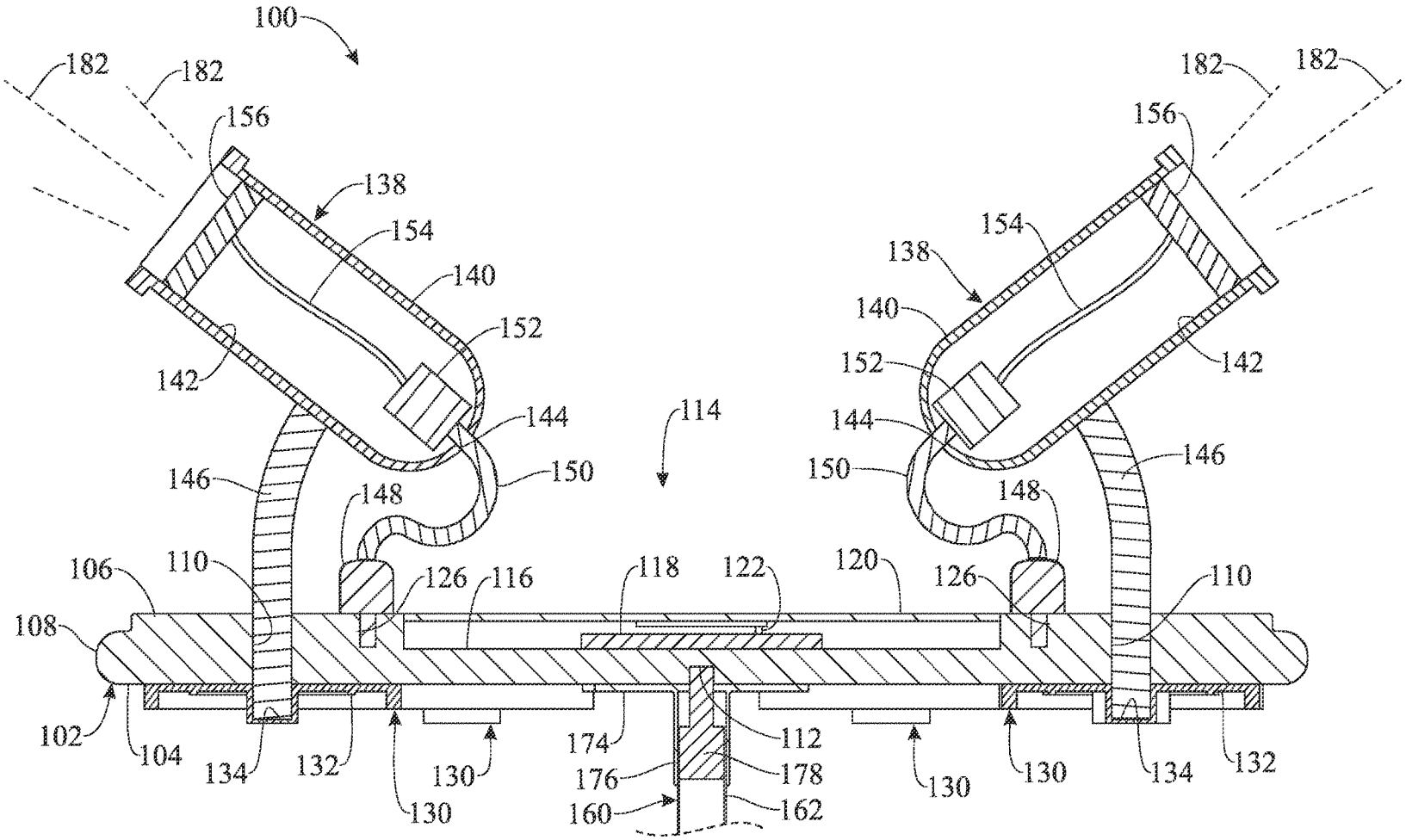
FIG. 7 is a cross-sectional view of the illustrative lamp platform assembly, taken along section lines 7-7 in FIG. 3.

The receptacle arm 162 of the platform stand 160 may be mounted to the lower platform surface 104 of the support platform 102 according to the knowledge of those skilled in the art. In some embodiments, the support platform 102 may be rotatably mounted to the receptacle arm 162 to facilitate selective rotation of the support platform 102 with respect to the receptacle arm 162. Accordingly, as illustrated in FIGS. 2 and 7, in some embodiments, an arm mount flange 174 may be attached to the lower platform surface 104 using screws (not illustrated) and/or other suitable fastening technique. An arm mount collar 176 may extend from the arm mount flange 174. As illustrated in FIG. 7, a leg insert 178 may be inserted in the open upper end of the receptacle arm 162. The leg insert 178 may insert into an insert cavity 112 provided in the lower platform surface 104 of the support platform 102 as the upper end of the receptacle arm 162 is inserted in the arm mount collar 176. Accordingly, the arm mount flange 174 and the arm mount collar 176 may rotate with respect to the stationary leg insert 178 and receptacle arm 162 of the platform stand 160 as the support platform 102 rotates with respect to the platform stand 160. Alternative techniques known by those skilled in the art may be used to rotatably mount the support platform 102 with respect to the platform stand 160. In some embodiments, a motor (not illustrated) may be provided on the platform stand 160 and operably engage the support platform 102 to rotate the support platform 102 with respect to the platform stand 160.

At least one lamp unit 138 may be provided on the upper platform surface 106 of the support platform 102. In some embodiments, each lamp unit 138 may be selectively positional to direct an emitted light beam in a selected direction or orientation. As illustrated in FIGS. 1-6, in some embodiments, the plurality of lamp units 138 may be arranged in a circular pattern on the support platform 102. For example and without limitation, in some embodiments, the lamp units 138 may be disposed in equally-spaced relationship to each other generally inside and adjacent to the outer platform edge 108 of the support platform 102. In other embodiments, the lamp units 138 may be arranged in an alternative pattern or array on the support platform 102.

As particularly illustrated in FIG. 7, each lamp unit 138 may include a lamp housing 140. In some embodiments, the lamp housing 140 may be generally elongated, as illustrated, with a lamp housing interior 142. At least one light emitting device 152 may be provided in the lamp housing interior 142. In some embodiments, the light emitting device 152 may include at least one light socket and at least one light bulb threaded into the light socket. In other embodiments, the light emitting device 152 may include at least one LED (light emitting diode). Accordingly, at least one lens 156 may be disposed in the lamp housing 140. A light transmitting tube 154 may connect the LED to the at least one lens 156. Each lamp unit 138 may be waterproofed according to the knowledge of those skilled in the art to prevent rain water from entering the lamp housing interior 142.

At least one lamp arm 146 may connect the lamp housing 140 of each lamp unit 138 to the support platform 102. In some embodiments, the lamp arm 146 may be selectively adjustable in configuration to provide selective vertical, horizontal and angular adjustments to the orientation of the lamp housing 140 with respect to the support platform 102.

The lamp arm 146 of each lamp unit 138 may be attached to the support platform 102 according to the knowledge of those skilled in the art. Accordingly, as illustrated in FIG. 7, in some embodiments, lamp arm openings 110 which correspond in position to the respective lamp arms 146 may extend through the support platform 102. Each lamp arm 146 may extend through the corresponding lamp arm opening 110. A lamp arm support plate 130 may support or retain each lamp arm 146 in the corresponding lamp arm opening 110. Each lamp arm support plate 130 may include a plate disk 132 which may be attached to the lower platform surface 104 using screws (not illustrated) and/or other suitable mechanical fastener or fasteners known by those skilled in the art. An arm cavity 134 may be provided in the plate disk 132 in alignment or registration with each corresponding lamp arm opening 110. The arm cavity 134 may receive the lower end of the lamp arm 146 to support the lamp arm 146 in the lamp arm opening 110.

As illustrated in FIGS. 1, 3, 4 and 7, at least one electrical system 114 may provide electrical current to the lamp units 138. In some embodiments, the electrical system 114 may capture and utilize solar energy. Accordingly, at least one solar panel recess 116 may be provided in the upper platform surface 106 of the support platform 102. At least one rechargeable battery 118 may be provided in the solar panel recess 116. At least one solar panel 120 may be disposed in the solar panel recess 116. The solar panel 120 may electrically interface with the battery 118 such as through suitable wiring 122.

The solar panel 120 may electrically interface with the light emitting device 152 of each lamp unit 138 according to the knowledge of those skilled in the art. In some embodiments, a power cable 150 may extend from each corresponding light emitting device 152. As illustrated in FIG. 7, the power cable 150 may extend through a cable opening 144 in the lamp housing 140 of the lamp unit 138 and terminate at a power module 148 on the upper platform surface 106. In some embodiments, each power module 148 may insert into a corresponding power module cavity 126 in the upper platform surface 106 of the support platform 102. Each power module 148 may electrically interface with the battery 118 typically through wiring (not illustrated).

In alternative embodiments, the electrical system 114 may be configured for connection to a wall electrical outlet (not illustrated). Accordingly, a power cord (not illustrated) may electrically interface with the power module 148 of each lamp unit 138 either directly or indirectly through the battery 118. A pronged electrical plug (not illustrated) may terminate the power cord for insertion into a standard wall electrical outlet (not illustrated). Alternatively, the electrical system 114 may include provisions for hardwiring the light emitting device 152 of each lamp unit 138 into a source of electrical power (not illustrated) according to the knowledge of those skilled in the art according to the knowledge of those skilled in the art according to the knowledge of those skilled in the art. The electrical system 114 may further include provisions such as switches or the like (not illustrated) for selectively energizing and deenergizing each lamp unit 138 in the assembly 100 either individually or collectively.

Figure 5:
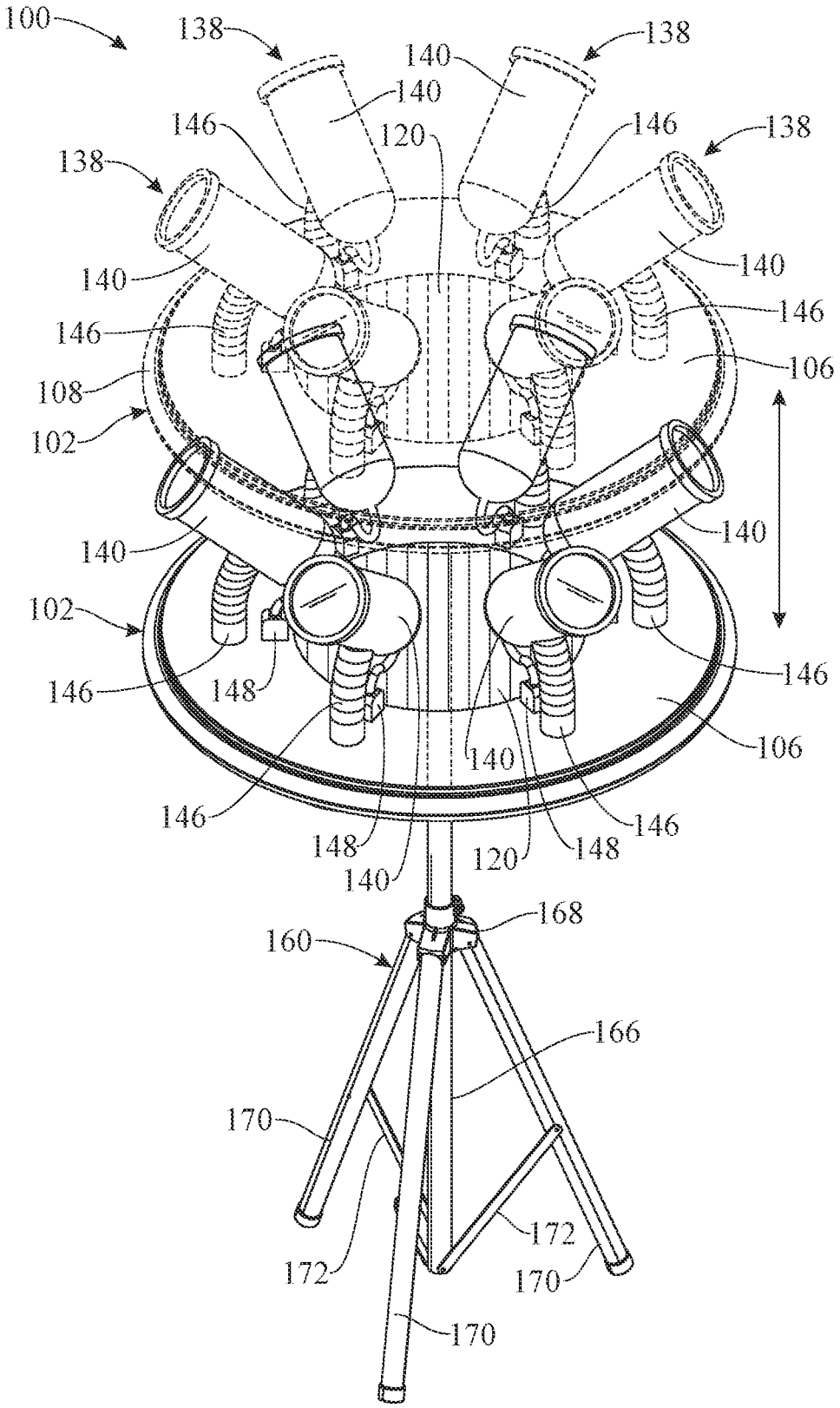
FIG. 5 presents a top perspective view of the illustrative lamp platform assembly, more particularly illustrating vertical adjustability of the lamp platform assembly according to some embodiments.
Figure 6:
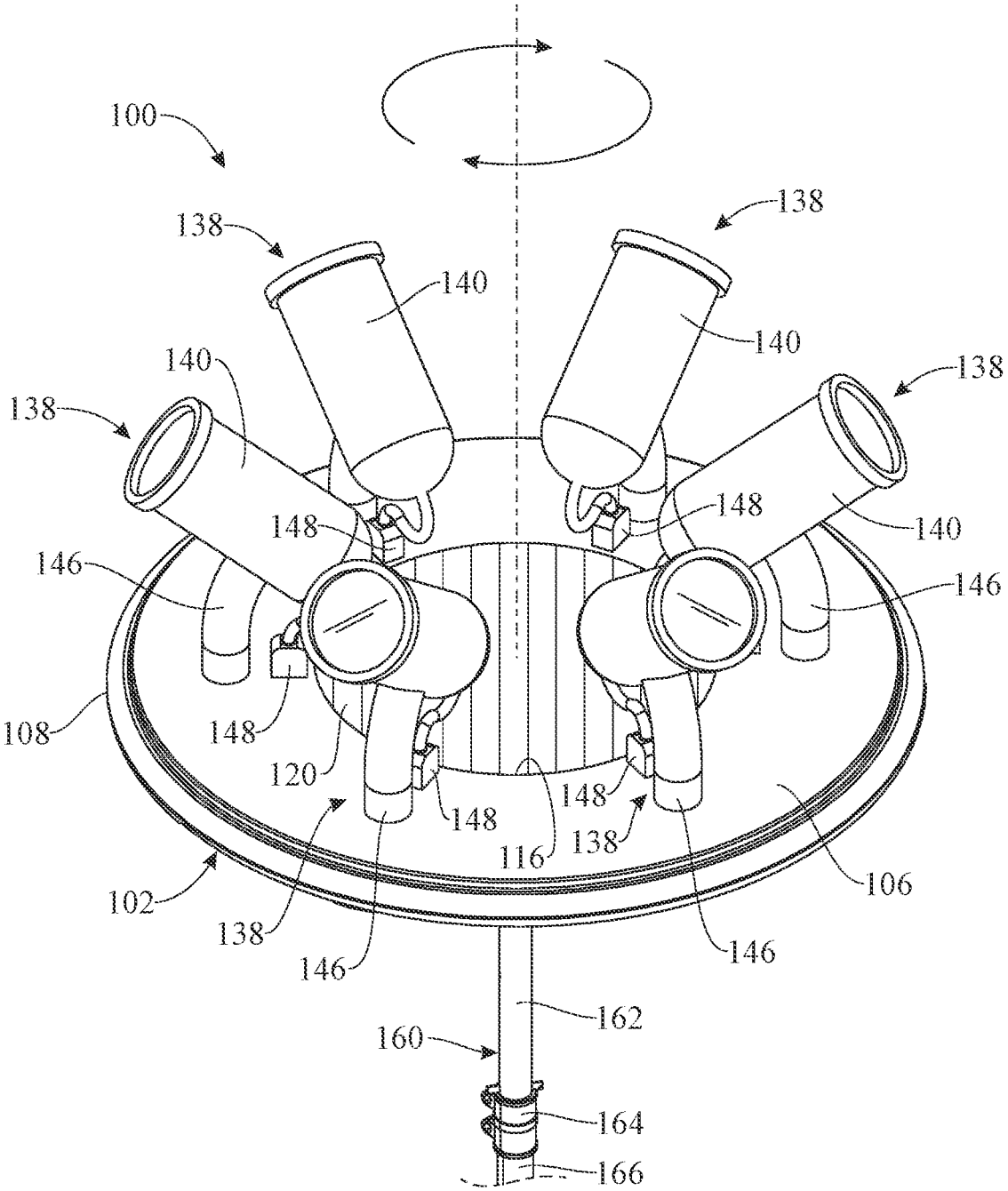
FIG. 6 presents a top perspective view of the illustrative lamp platform assembly, more particularly illustrating rotational adjustability of the lamp platform assembly according to some embodiments.

In typical application of the assembly 100, the platform stand 160 may be deployed on a flat surface (not illustrated) typically by pivoting the stand legs 170 outwardly from the leg support member 116 as the leg stabilizers 172 unfold and extend between the leg support member 166 and each corresponding stand leg 170. The height of the support platform 102 may be selected, as illustrated in FIG. 5, typically by manipulation of the receptacle arm collar 164 (FIG. 1). The rotational position of the support platform 102 may be adjusted typically by rotating the support platform 102 with respect to the receptacle arm 162 of the platform stand 160, as illustrated in FIG. 6.

In some embodiments, selective adjustments to the vertical, horizontal and/or angular orientations of the lamp housing 140 of each lamp unit 138 may be made typically by bending the lamp arm 146 of each lamp unit 138. Accordingly, the lamp units 138 may be oriented or aimed in any desired direction to illuminate one or more objects located at a distance from the assembly 100.

Figure 4:
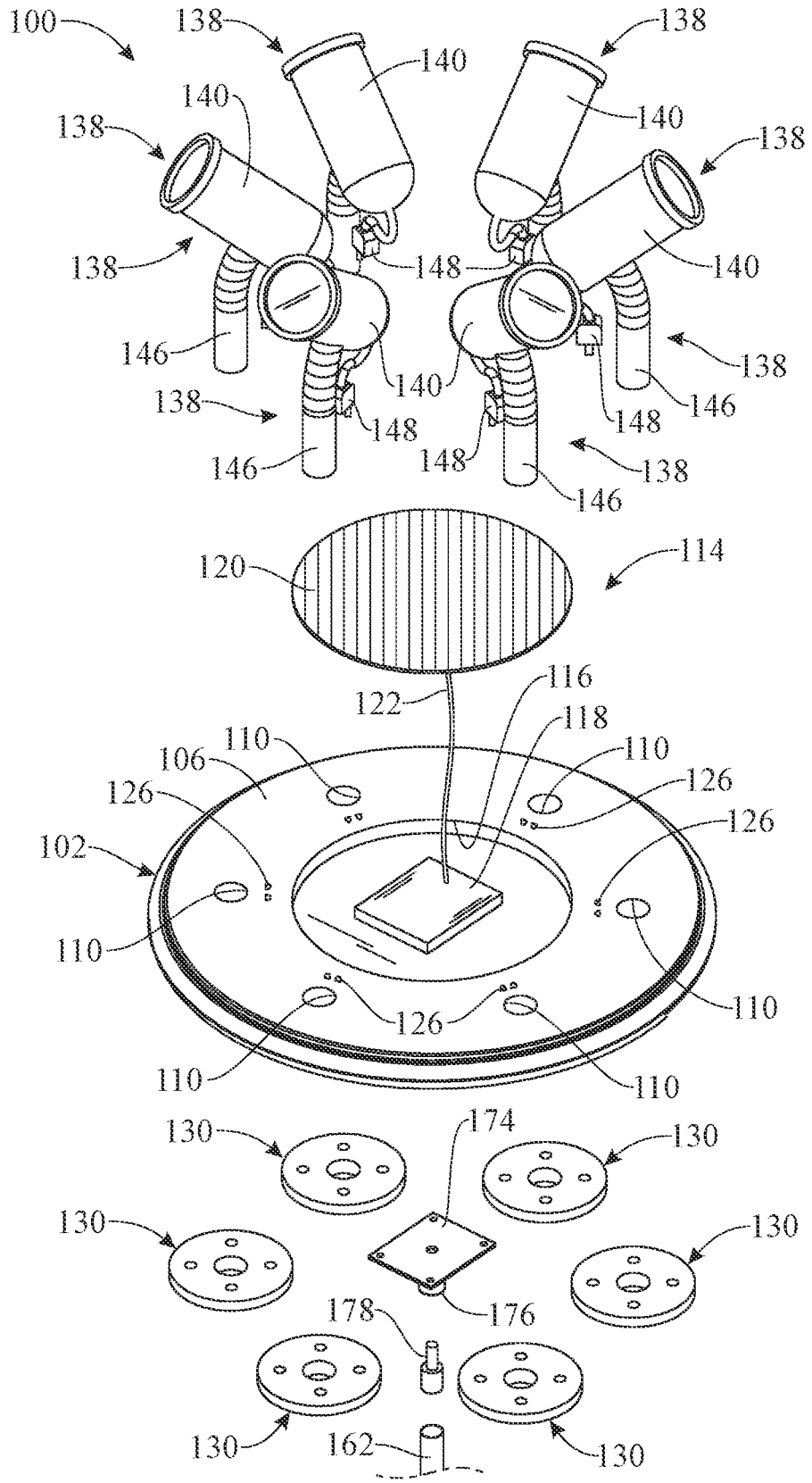
FIG. 4 presents an exploded top perspective view of the illustrative lamp platform assembly.

As set forth above, in some embodiments, the electrical system 114 may include the solar panel or panels 120 which electrically interface with the rechargeable battery 118 (FIG. 4). Accordingly, the solar panel 120 may receive and convert sunlight into electrical current which is stored in the battery 118. Electrical current may flow from the battery 118 to the power module 148 of each lamp unit 138 to a emit light beam 182 from the lamp housing 140 through the lens 156 of each lamp unit 138, as illustrated in FIG. 7.

After use of the assembly 100, the stand legs 170 may be folded against the leg support member 166 of the platform stand 160 to facilitate space-efficient storage. In some embodiments, the support platform 102 may be selectively detachable from the receptacle arm 162 of the platform stand 160 according to the knowledge of those skilled in the art for storage purposes.

It will be appreciated by those skilled in the art that the assembly 100 facilitates illumination of one or more objects or areas in a variety of different orientations selected by the user. Multiple assemblies 100 may be stackable for space-efficient storage. In some embodiments, the assembly 100 can be easily disassembled and folded for ease in transport and storage. In some applications, the support platform 102 can be inverted to allow the lamp units 138 to project the light beams 182 (FIG. 7) downwardly. In some embodiments, the support platform 102 may be directly mounted on a wall or roof (not illustrated) of a house or office building or a fence post or the like to attract attention or to illuminate a flag on a flagpole or an advertisement on a wall or other structure, for example and without limitation. The assembly 100 is amenable to indoor or outdoor use and can be constructed accordingly in sizes which conform to any intended use. In some applications, the support platform 102 may be suspended from an indoor or outdoor structure (not illustrated) according to the knowledge of those skilled in the art.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A lamp platform assembly for emitting at least one light beam in various patterns, directions or orientations, comprising:

a multi-positional support platform, wherein the support platform is circular with a lower platform surface, an upper platform surface, and a circular outer platform edge extending between the lower platform surface and the upper platform surface;

at least one lamp unit carried by the support platform, each lamp unit selectively positional to direct an emitted light beam in a selected direction or orientation wherein each lamp unit includes a lamp housing on the upper platform surface of the support platform and at least one light emitting device in the lamp housing;

at least one lamp arm connecting the lamp housing of each lamp unit to the support platform, and further wherein the at least one lamp arm may be adjustable;

a lamp arm opening extending through the support platform, and further wherein each lamp arm extends through the lamp arm opening;

a lamp arm support plate supports the lamp arm in the lamp arm opening, and further wherein each lamp arm support plate includes a plate disk and an arm cavity in the plate disk; and at least one electrical system electrically interfacing with the at least one lamp unit, the at least one electrical system configured to provide electrical power to the at least one lamp unit.

2. The lamp platform assembly of claim 1, wherein the plurality of lamp units are arranged in a circular pattern on the support platform.

3. The lamp platform assembly of claim 1, wherein the support platform is selectively adjustable in height and selectively rotationally adjustable.

4. The lamp platform assembly of claim 1, wherein the support platform is mounted to a platform stand.

5. The lamp platform assembly of claim 4, wherein the platform stand includes a plurality of stand legs.

6. The lamp platform assembly of claim 5, wherein the plurality of stand legs of the platform stand are adjustable.

7. The lamp platform assembly of claim 4, wherein the platform stand may include a tripod stand.

8. The lamp platform assembly of claim 4, wherein an arm receptacle is supported by the plurality of stand legs and a platform support arm is telescopically extendable from the arm receptacle, and further wherein the support platform may be supported by the platform support arm.

9. The lamp platform assembly of claim 1, wherein the electrical system is configured to capture and utilize solar energy.

10. The lamp platform assembly of claim 1, wherein the electrical system includes at least one solar panel recess provided in the upper platform surface of the support platform, and further wherein at least one solar panel seated in the solar panel recess is electrically interfaced to each lamp unit.

11. The lamp platform assembly of claim 10, wherein at least one rechargeable battery is provided in the solar panel recess, and further wherein the at least one solar panel is electrically interface with the at least one battery.

12. The lamp platform assembly of claim 1, wherein the at least one light emitting device of each lamp unit may include at least one light emitting diode.

13. The lamp platform assembly of claim 12, wherein at least one lens is disposed in the lamp housing and a light tube connecting the light emitting diode to the at least one lens.

14. A lamp platform assembly for emitting at least one light beam in various patterns, directions or orientations, comprising:

a multi-positional support platform, wherein the support platform is circular with a lower platform surface, an upper platform surface, and a circular outer platform edge extending between the lower platform surface and the upper platform surface;

a platform stand mounted to the support platform, the platform stand having a plurality of adjustable stand legs, wherein an arm receptacle is supported by the plurality of stand legs and a platform support arm is telescopically extendable from the arm receptacle, and further wherein the support platform may be supported by the platform support arm;

at least one lamp unit carried by the upper platform surface, each lamp unit selectively positional to direct an emitted light beam in a selected direction or orientation wherein each lamp unit includes a lamp housing on the upper platform surface of the support platform and at least one light emitting device in the lamp housing;

at least one lens is disposed in the lamp housing and a light tube connecting the light emitting diode to the at least one lens;

at least one lamp arm connecting the lamp housing of each lamp unit to the support platform, and further wherein the at least one lamp arm may be adjustable;

a lamp arm opening extending through the support platform, and further wherein each lamp arm extends through the lamp arm opening;

a lamp arm support plate supports the lamp arm in the lamp arm opening, and further wherein each lamp arm support plate includes a plate disk and an arm cavity in the plate disk; and at least one electrical system electrically interfacing with the at least one lamp unit, the at least one electrical system configured to capture and utilize solar energy to provide the solar energy to power the at least one lamp unit.

* * * * *